US005881392A

United States Patent [19]

Koerner et al.

[11] Patent Number: 5,881,392

[45] Date of Patent: Mar. 16, 1999

[54] TROUSERS WITH A BELT RETAINING LOOP BELOW THE WAISTBAND

[76] Inventors: Gregory Alan Koerner, 2712 Westview, Dodge City, Kans. 67801; H. Alice States, 700 Westridge, Hutchinson, Kans. 67501

[21] Appl. No.: 76,599

[22] Filed: May 11, 1998

[51] Int. Cl.[6] ..... A41D 1/06

[52] U.S. Cl. ..... 2/227; 2/79; 2/311; 2/69

[58] Field of Search ..... 2/227, 236, 242, 2/22, 23, 228, 79, 80, 311, 312, 338, 69

[56] References Cited

U.S. PATENT DOCUMENTS

| | | | |
|---|---|---|---|
| 1,247,873 | 11/1917 | Parker | 2/227 |
| 2,742,647 | 4/1956 | Khalil | 2/236 |
| 3,435,462 | 4/1969 | Bank | 2/227 |
| 5,634,215 | 6/1997 | DeBaene | 2/227 |
| 5,689,832 | 11/1997 | Head | 2/227 |

*Primary Examiner*—Michael A. Neas
*Assistant Examiner*—Tejash D Patel
*Attorney, Agent, or Firm*—Kenneth Jack

[57] ABSTRACT

A clothing assembly comprising of trousers, the trousers having a waist, a waistband, a right leg, and a left leg; and the trousers having a belt retaining loop, the belt retaining loop being fixedly attached to the right side of the trousers and positioned thereon so that the upper end of the belt loop lies below the waistband; and comprising a flexible belt, the flexible belt being positioned to form an upper loop and a lower loop, the upper loop extending upwardly and leftwardly from the belt retaining loop, the lower loop extending downwardly and leftwardly from the belt retaining loop, the upper loop encircling the waist of the trousers, and the lower loop encircling the right leg of the trousers.

12 Claims, 2 Drawing Sheets

TROUSERS WITH A BELT RETAINING LOOP BELOW THE WAISTBAND

FIELD OF THE INVENTION

This invention relates to clothing. In particular, this invention relates to trousers and belt combinations. More particularly, this invention relates to novel assemblies of trousers and belts.

BACKGROUND OF THE INVENTION

Items of women's apparel and clothing commonly are tailored so that they display various stylistic or fashionable lines. For example, a woman wearing a bateau neck blouse or dress displays a stylistic horizontal neckline, extending from the top of her left shoulder to the top of her right shoulder. Where a bateau neck blouse is worn in combination with a yoke skirt, additional horizontal lines are displayed at the waistline and hipline. Another example of display by women's clothing or apparel of stylistic lines is a women's draped necked dress or blouse which displays a series of concentric curved lines at the neckline. Another example is the diagonally angled lines of a women's dress having a plunging neckline, or the crossing diagonal lines of a women's wrap around dress.

Several common items of clothing or apparel worn by both men and women perform a primary utilitarian function, and perform a secondary stylistic line of displaying function; the secondary function being dictated, sometimes undesirably, by the primary function. For example, the primary utilitarian function of the hatband of a hat is prevention of expansion of the hat, and the secondary function of the hatband is display of a stylistic horizontal line. The horizontal line of the hatband follows and is integral to its utilitarian function. Similarly, the brim of a lady's hat commonly displays a stylistic horizontal line while shading the wearer's face, the shade being the primary function of the brim. Another common example of such primary and secondary functions is suspenders which display stylistic vertical lines while performing their primary utilitarian function of trouser suspension. Similarly, a common belt which, when worn in combination with common trousers, primarily functions to mechanically suspend the trousers in proper wearing position, and secondarily functions to display a stylistic horizontal line. In each of the above examples, the secondary stylistic function is potentially undesirably dictated by the primary utilitarian function. For example, where common trousers, particularly women's trousers, are in need of mechanically assisted suspension, it is not always desirable to achieve either of the secondary functions common to belts and suspenders; i.e, displaying stylistic horizontal and vertical lines. Commonly known configurations of trousers, belt, belt loops and suspenders may cause a wearer, not wishing to display stylistic horizontal or vertical lines, to undesirably compromise; the wearer choosing to utilize a common belt or suspenders despite their horizontal and vertical line displaying functions.

The instant inventive clothing assembly provides a solution to the above problem by providing a novel and unique trouser and belt assembly, such assembly allowing a women's belt to perform a primary trouser suspending utilitarian function while performing a secondary function of displaying stylistic diagonal crossing lines.

BRIEF SUMMARY OF THE INVENTION

The instant inventive clothing assembly preferably comprises a pair of lady's trousers, the trousers preferably having a first belt loop overlying its waistband, and located immediately to the left of its waistband extension; having a second belt loop overlying its waistband and located above the trouser's left side seam; having a third belt loop overlying its waistband and located above the trouser's left t back pocket, if any; and having a fourth belt loop overlying the trouser's right side seam, the upper end of the fourth belt loop being two to three inches below the lower edge of its waistband. Preferably, all belt loop attachments are sewn seams. Ladies trousers having such a configuration of belt loops are adapted for receiving and retaining a long and preferably narrow lady's belt which diagonally encircles the trouser's waist, and which diagonally encircles the trouser's right leg, the belt crossing itself beneath the fourth belt loop.

In assembling the instant inventive belt and trouser combination, the tip of the belt is preferably extended leftwardly beneath the first belt loop, thence rearwardly beneath the second belt loop, thence rightwardly beneath the third belt loop, thence downwardly and forwardly beneath the fourth belt loop, thence leftwardly and downwardly, thence rearwardly below the trouser's crotch, thence rightwardly and upwardly, thence upwardly and forwardly to again pass beneath the fourth belt loop, and thence upwardly and leftwardly to the approximate point of beginning for attachment to the belt's buckle.

Preferably, the belt of the instant inventive assembly is composed of flexible leather material. Also preferably, the belt is narrow, having a width between ⅜ of one inch and ¾ of one inch. The additional length of the belt over and above the length of a common waist encircling belt is variable, depending upon the circumference of the legs of the trouser, among other factors. Preferably, the trousers are of the blue jean denim type; however, the instant novel belt and trouser assembly is applicable to all types of trousers.

Where leftwardly oriented stylistic diagonal lines are desired, the first belt loop is preferably sewn immediately to the right of the trouser's waistband extension; the second belt loop is sewn over the waistband and above the trouser's right seam; the third belt loop is sewn over the waistband and above the right back pocket, if any; the fourth belt loop is sewn over the left side seam, two to three inches below the lower edge of the waistband; and the belt is extended in a reverse of the order described above.

Accordingly, it is an object of the present invention to provide a novel trouser and belt assembly enabling the belt to perform a primary utilitarian function of mechanically suspending the trousers, and to simultaneously perform a secondary function of displaying stylistic diagonally crossing lines.

Other and further objects, benefits, and advantages of the present inventive clothing assembly will become apparent to those skilled in the art upon review of the Detailed Description which follows, and upon review of the appended drawings.

BRIEF DESCRIPTION OF THE DRAWINGS

Drawing

Drawing

DETAILED DESCRIPTION OF THE PREFERRED EMBODIMENT

Figure 1:
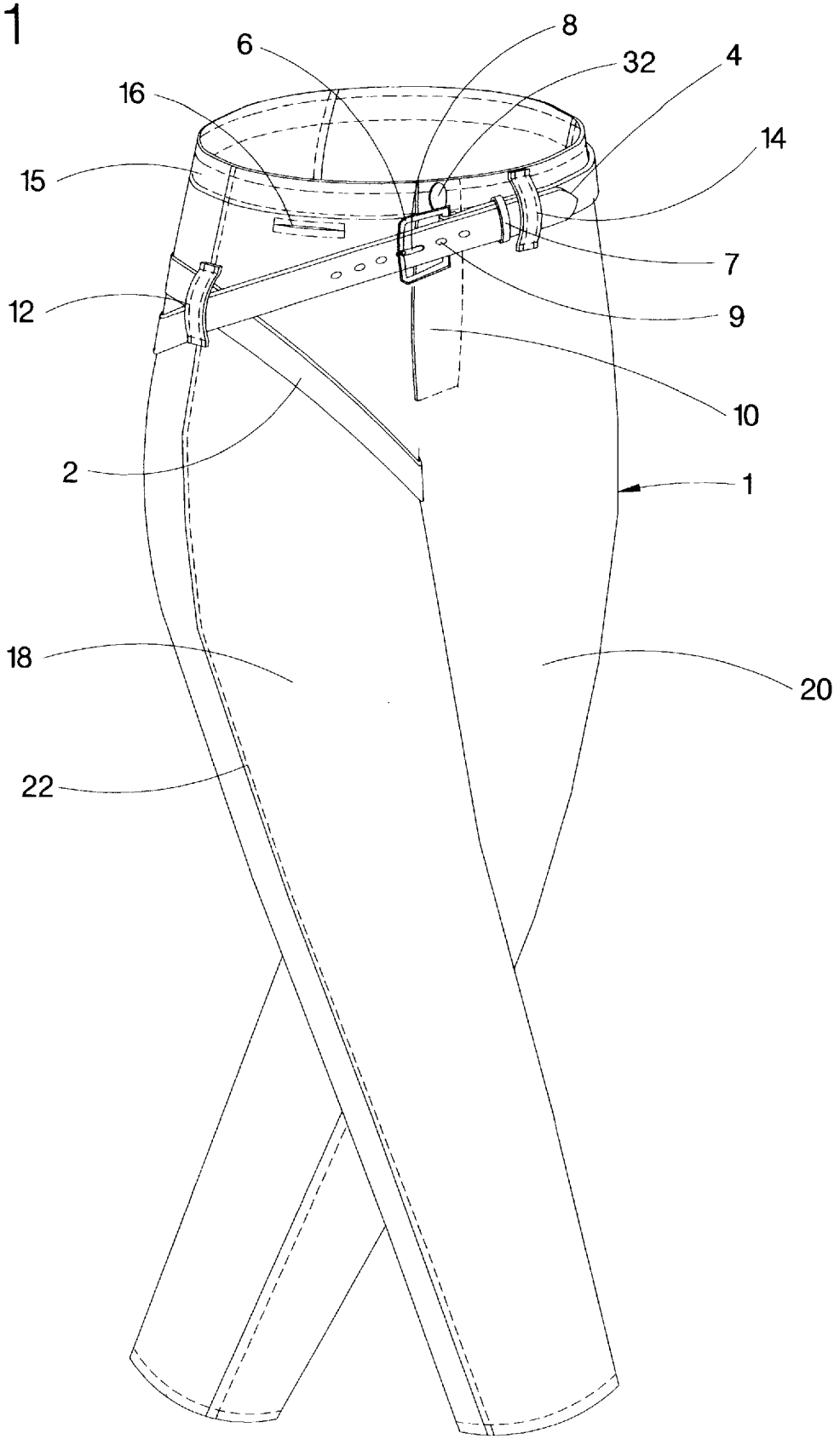
FIG. 1 is a perspective front view of the present inventive trouser and belt assembly.

Referring now to the drawings, and in particular to FIG. 1, ladies' trousers 1, preferably of the "blue jean" denim type, have a right leg 18, a left leg 20, a waist having a waistband 15 extending annularly around its upper end, a waistband extension 10 forming a fly, a slot pocket 16 and a snap 32.

Figure 2:
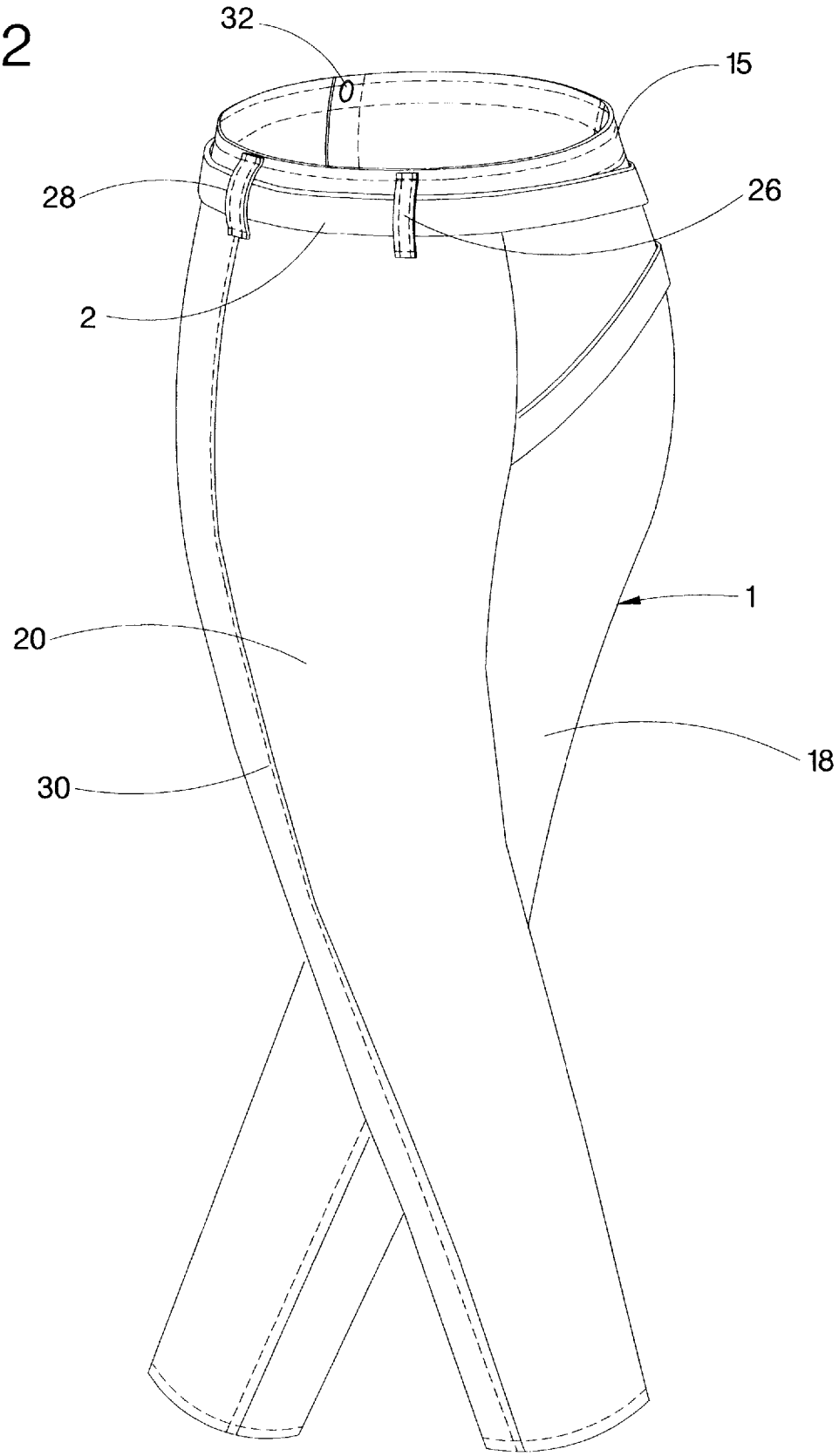
FIG. 2 is a perspective rear view of the trouser and belt assembly depicted in FIG. 1.

The tip end 4 of a flexible leather belt 2 is preferably extended leftwardly beneath a first waistband belt loop 14, thence, referring to Drawing FIG. 2, rearwardly beneath a second waistband belt loop 28, thence rightwardly beneath a third waistband belt loop 26, then, referring again to FIG. 1, extending forwardly and downwardly beneath a fourth belt loop 12. Preferably, the fourth belt loop 12 is sewn upon the right side of the trousers 1 so that it overlies its right seam 22, and is positioned between two and three inches below the lower edge of the waistband 15. From beneath the fourth belt loop 12, the tip 4 of the belt 2 is further extended leftwardly and downwardly, thence extending rearwardly beneath the crotch of the trousers 1. Referring to FIG. 2, the belt 2 is then extended rightwardly and upwardly to again pass, referring to FIG. 1, beneath the fourth belt loop 12, and thence upwardly and leftwardly for attachment to the belt buckle 6, the belt 2 being secured by a tongue 8 which is extended through a punch hole 9. Upon such buckling and fastening, the tip end 4 of the belt 12 further extends beneath a belt tip retaining loop 7 and then the tip end 4 again passes beneath the first waistband belt loop 14. Preferably, the width of the belt 2 is between three-eighths of one inch and threefourths of one inch.

In an alternate configuration (not shown) of the present inventive trouser and belt assembly, a left side belt crossover may be accommodated. In such configuration, referring simultaneously to FIGS. 1 and 2, the first waistband belt loop 14 is located immediately to the right of the waistband extension 10; the second waistband belt loop 28 is located immediately above the right leg seam 22 rather than above the left leg seam 30; the third waistband belt loop 26 is shifted rightwardly over a right back pocket, if any; and the fourth belt loop 12 is located upon the left leg seam 30 rather than upon the right leg seam 22. Where the belt loops are so configured, the belt 2 is installed in a reverse of the manner described above and drawn in FIGS. 1 and 2. Such belt installation provides crossing diagonal lines upon a wearer's left hip rather than the right hip.

The belt and trouser assembly as depicted in FIGS. 1 and 2, allows the belt 2 to perform its primary utilitarian function of suspending the trousers 2 in a proper wearing position while also performing a secondary function of displaying diagonal and crossing stylistic lines.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. A clothing assembly comprising:

(a) trousers, the trousers having a waist, the waist having a waistband, a right leg, a left leg, a right side, a left side, a front side, and a back side;

(b) a first belt retaining loop, the first belt retaining loop having an upper end, a lower end, an outwardly facing surface and an inwardly facing surface, the upper and lower ends of the first belt retaining loop being fixedly attached to the right side of the trousers and positioned thereon so that the upper end of the first belt retaining loop lies below the waistband; and (c) a flexible belt having a width, the flexible belt being positioned to form an upper loop and a lower loop, the flexible belt being further positioned so that the upper loop extends upwardly and leftwardly from the inwardly facing surface of the first belt retaining loop, the flexible belt being further positioned so that the lower loop extends downwardly and leftwardly from the inwardly facing surface of the first belt retaining loop, the flexible belt being further positioned so that the upper loop substantially encircles the waist of the trousers, the flexible belt being further positioned so that the lower loop substantially encircles the right leg of the trousers.

2. The clothing assembly of claim 1 further comprising a plurality of second belt retaining loops, each second belt retaining loop having an upper end, an outwardly facing surface, an inwardly facing surface, and a lower end, the upper and lower ends of the second belt retaining loop being fixedly attached to the trousers and positioned thereon so that the second belt retaining loops overlie the waistband of the trousers; and wherein the flexible belt is further positioned so that its upper loop extends beneath the inwardly facing surfaces of the second belt retaining loops.

3. The clothing assembly of claim 2 wherein the flexible belt has a buckle attachment end and a tip end, the tip end of the flexible belt having a plurality of punch holes extending therethrough, and further comprising a buckle, the buckle being pivotally attached to the buckle attachment end of the flexible belt.

4. The clothing assembly of claim 3 wherein the width of the flexible belt is no less than three-eighths of one inch, and wherein the width of the flexible belt is no greater than three-fourths of one inch.

5. The clothing assembly of claim 4 wherein the trousers are ladies' trousers.

6. The clothing assembly of claim 5 wherein the trousers comprise denim blue jean fabric, and wherein the fixed attachments of the first and second belt retaining loops comprise sewn seams.

7. A clothing assembly comprising:

(a) trousers, the trousers having a waist, the waist having a waistband, a right leg, a left leg, a right side, a left side, a front side, and a back side;

(b) a first belt retaining loop, the first belt retaining loop having an upper end, a lower end, an outwardly facing surface and an inwardly facing surface, the upper and lower ends of the first belt retaining loop being fixedly attached to the left side of the trousers and positioned thereon so that the upper end of the first belt retaining loop lies below the waistband; and (c) a flexible belt having a width, the flexible belt being positioned to form an upper loop and a lower loop, the flexible belt being further positioned so that the upper loop extends upwardly and rightwardly from the inwardly facing surface of the first belt retaining loop, the flexible belt being further positioned so that the lower loop extends downwardly and rightwardly from the inwardly facing surface of the first belt retaining loop, the flexible belt being further positioned so that the upper loop substantially encircles the waist of the trousers, the flexible belt being further positioned so that the lower loop substantially encircles the left leg of the trousers.

8. The clothing assembly of claim 7 further comprising a plurality of second belt retaining loops, each second belt retaining loop having an upper end, an outwardly facing surface, an inwardly facing surface, and a lower end, the upper and lower ends of the second belt retaining loop being fixedly attached to the trousers and positioned thereon so that the second belt retaining loops overlie the waistband of the trousers; and wherein the flexible belt is further positioned so that its upper loop extends beneath the inwardly facing surfaces of the second belt retaining loops.

9. The clothing assembly of claim 8 wherein the flexible belt has a buckle attachment end and a tip end, the tip end of the flexible belt having a plurality of punch holes extending therethrough, and further comprising a buckle, the buckle being pivotally attached to the buckle attachment end of the flexible belt.

10. The clothing assembly of claim 9 wherein the width of the flexible belt is no less than three-eighths of one inch, and wherein the width of the flexible belt is no greater than three-fourths of one inch.

11. The clothing assembly of claim 10 wherein the trousers are ladies' trousers.

12. The clothing assembly of claim 11 wherein the trousers comprise denim blue jean fabric, and wherein the fixed attachments of the first and second belt retaining loops comprise sewn seams.

* * * * *